US005741162A

United States Patent [19]

Kourimsky et al.

[11] Patent Number: 5,741,162

[45] Date of Patent: Apr. 21, 1998

[54] ELECTRICAL CONTACT HAVING IMPROVED LOCKING LANCES

[75] Inventors: Friedrich Josef Alois Kourimsky, Bensheim; Gheorghe Hotea, Griesheim, both of Germany

[73] Assignee: The Whitaker Corporation, Wilmington, Del.

[21] Appl. No.: 838,241

[22] Filed: Apr. 16, 1997

Related U.S. Application Data

[63] Continuation of Ser. No. 519,904, Aug. 28, 1995, abandoned.

[30] Foreign Application Priority Data

Sep. 1, 1994 [GB] United Kingdom ..... 9417572

[51] Int. Cl.[6] ..... H01R 13/432

[52] U.S. Cl. ..... 439/748; 439/746

[58] Field of Search ..... 439/748, 749, 439/746, 747

[56] References Cited

U.S. PATENT DOCUMENTS

| | | | |
|---|---|---|---|
| 3,562,698 | 2/1971 | Merry | 339/217 |
| 3,789,343 | 1/1974 | Hirokawa et al. | 339/49 R |
| 3,932,013 | 1/1976 | Yeager et al. | 339/19 |
| 3,966,295 | 6/1976 | Hyland et al. | 339/176 MF |
| 4,003,617 | 1/1977 | Witek, Jr. et al. | 339/17 C |
| 4,371,227 | 2/1983 | Yosimura | 339/211 |
| 4,446,684 | 5/1984 | Grant et al. | 339/176 M |
| 4,620,766 | 11/1986 | Leonard | 339/217 S |
| 4,907,990 | 3/1990 | Bertho et al. | 439/851 |
| 5,035,657 | 7/1991 | Hass et al. | 439/748 |
| 5,131,873 | 7/1992 | Gierut et al. | 439/851 |
| 5,207,603 | 5/1993 | Peloza | 439/872 |
| 5,240,439 | 8/1993 | Egenolf | 439/745 |
| 5,266,056 | 11/1993 | Baderschneider et al. | 439/745 |
| 5,342,221 | 8/1994 | Petersen | 439/677 |

FOREIGN PATENT DOCUMENTS

| | | | |
|---|---|---|---|
| 1 513 185 | 5/1968 | France . | |
| 2 266 329 | 10/1975 | France . | |
| 2220310 | 1/1990 | United Kingdom | 439/745 |

*Primary Examiner*—Neil Abrams
*Assistant Examiner*—T. C. Patel
*Attorney, Agent, or Firm*—Driscoll A. Nina; Anton P. Ness

[57] ABSTRACT

Improved locking lance structure for an electrical contact having a body portion from which a locking lance is cantilevered from a base where the base is resiliently interconnected to the body portion to provide sufficient resiliency for easier seating of the contact within a passageway of a housing and sufficient resilience so that the locking lance may function to position the contact within the passageway.

10 Claims, 3 Drawing Sheets

ELECTRICAL CONTACT HAVING IMPROVED LOCKING LANCES

This application is a Continuation of application Ser. No. 08/519,904 filed Aug. 28, 1995, now abandoned.

BACKGROUND OF THE INVENTION

1. Field of the Invention

This invention relates to electrical contacts and in particular to those electrical contacts having a locking lance for positioning the contact within a passageway of a housing.

2. Description of the Prior Art

It is known in the art to include locking lances along an electrical contact for positioning of the contact within a passageway of a housing, for example a connector housing. Typically, these locking lances are cantilevered members joined at a base and having a free end extending outwardly and away from the contact in the opposite direction to that of the insertion of the contact into the passageway. In one use, this enables the locking lance to be deflected inwardly as it is inserted past a shoulder so that the contact may be positioned within the passageway. Once the locking lance passes the shoulder, it will resiliently return to its original position such that its free end will interferingly abut the shoulder in order to prevent the contact from exiting the passageway opposite the direction of insertion.

While this design has worked adequately in the past, as contacts are developing there is a trend toward miniaturization, to increase the number of features incorporated into the contact and to improve the electrical performance of the contact. As contacts are miniaturized and additional features are incorporated into the contact structure, less and less of the contact is available to be dedicated to locking lance structure. The problem that then arises is that the length of the contact available for locking lance structure becomes too short to work within the elastic range of the material. Another problem arises as the electrical performance of the contact is improved, the material selected to meet those requirements may not have the desired resiliency characteristics necessary for a properly functioning locking lance. In either case, the lack of resiliency makes seating the contact in its final position within the passageway of the housing difficult due to the high insertion forces now required and prevents the locking lance from resiliently returning to the outwardly disposed position after passing the shoulder, thereby negating the desired positive locking of the contact within the housing.

SUMMARY OF THE INVENTION

An object of the invention is to provide an electrical contact having increased effective resiliency of the locking lance.

A further object is to the increase the resiliency in a simple and economical way.

A further object is to increase the effective resiliency in a manner that is applicable to a wide variety of contact styles and configurations.

Finally, another object is to reduce the insertion forces required to seat the contact within the passageway of the housing.

These and other objects are accomplished by providing an electrical contact with a locking lance for retaining the contact within a passageway of the housing, the contact being characterized in that the locking lance extends from a resilient base.

These and other objects can also be accomplished by providing an electrical contact with a locking lance for retaining the contact within a passageway of a housing, the contact being characterized in that the locking lance is provided with compound resiliency.

These and other objects can also be accomplished by providing an electrical contact with a locking lance for retaining the contact within a passageway of a housing, the contact being characterized in that the locking lance is cantilevered from a position offset from where the locking lance abuts the housing, thereby providing a lever arm for aiding in deflecting the lance.

DETAILED DESCRIPTION OF THE PREFERRED EMBODIMENT

Figure 1:
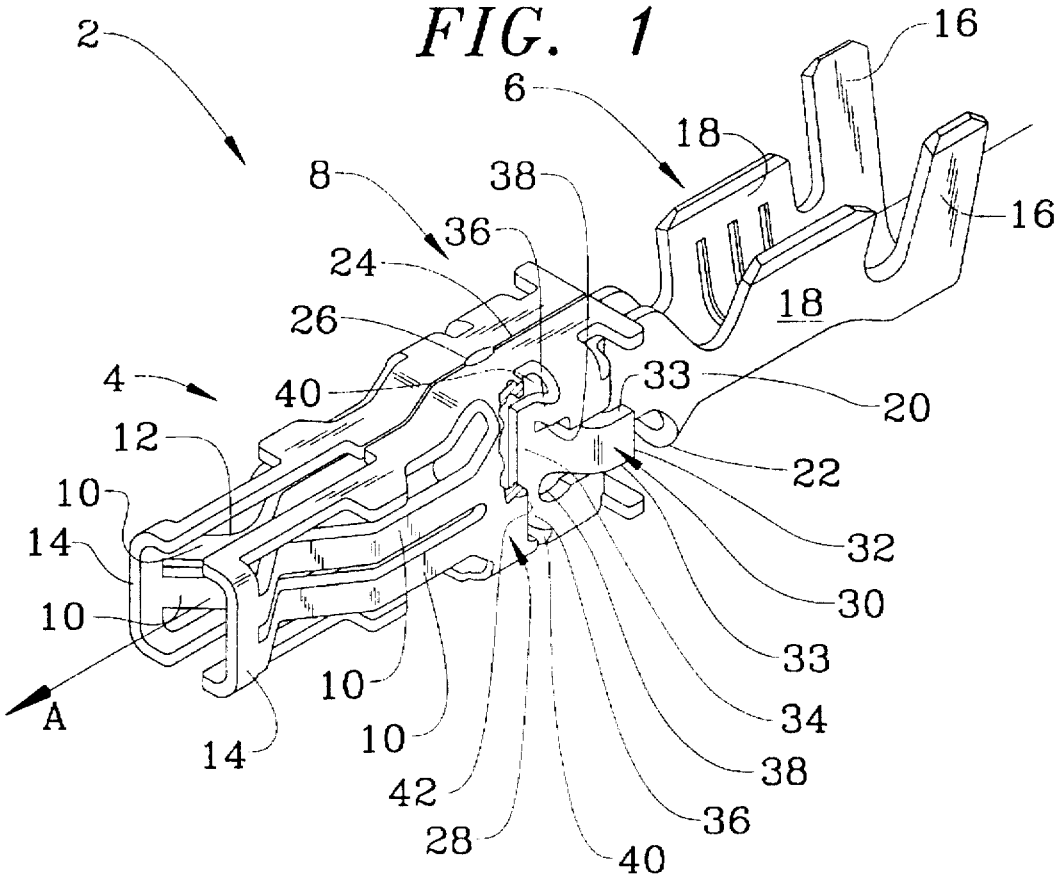
FIG. 1 is a perspective partially broken away view of an electrical contact incorporating the present invention.

With reference first to FIG. 1, an electrical connector incorporating the present invention is shown generally at 2. The electrical connector 2 includes a contact portion 4 and a conductor engaging portion 6 with a body portion 8 therebetween. The contact 2 is to be inserted into the passageway of a housing along the direction of arrow A. Contact 2 is of one piece construction and has a generally rectangular cross-section at the contact portion 4 and the body portion 8.

It should be noted that while the invention is illustrated incorporated into contacts of this type, the invention should not be so limited. It is fully envisioned that this invention may be incorporated into contacts of two-piece construction having an outer back-up spring or protective cover about an inner contact portion, where the locking lance is provided either on the inner contact, or the outer back-up spring. This invention may also be incorporated into cylindrical contact receptacle structure or into contact pin structure. In essence, this invention is applicable to any structure that incorporates the use of one or more locking lances for the retention or positioning of a contact within a housing where it is necessary that the locking lances behave in a resilient manner. The term "body portion", as used herein, is to indicate the structure from which the locking lance extends.

The contact portion 4 includes opposing pairs of contact arms 10 extending forwardly from the body 8 and converging towards each other at contact surfaces 12 which are spaced apart for electrical engagement of a mating apparatus (not shown), such as a tab terminal. Forward of the contact surfaces 12, the contact arms diverge for receiving the mating apparatus, such as a tab terminal. The contact arms 10 are supported by a protective cage structure 14 that is unitary with the forward ends of the respective contact arms 10 and extend backward therealong where they are unitarily interconnected with the body portion 8. Other contact portion 4 configurations may be used as desired, as indicated above.

Opposite the contact portion 4 is the conductor engaging portion 6. The conductor engaging portion 6 shown is a conventional F-crimp design. A pair of rearward crimp arms 16 are constructed for folding about and engaging the insulation surrounding a conductor, while forward crimp arms 18 are constructed for inwardly crimping upon the conductor itself. It is fully envisioned that other conductor engaging configurations may replace the one illustrated here, for example other crimp designs may be used, solder structure may be incorporated, insulation displacement contact technology may be incorporated, or a contact portion, such as that shown at 4, may be incorporated at this end also.

Extending from the conductor engaging portion 6, towards the body portion 8, is a transition section 20 that incorporates a secondary locking opening 22 therein. The secondary locking opening 22 is provided for the receipt of an independent member (not shown) of a housing to provide further insurance that the contact 2 is retained within the passageway.

The contact 2 is formed by stamping and folding the material into the desired shape. This process produces a seam at 24. This seam 24 may be closed by laser welding or any other technique. The body portion 8 includes at least one surface 28 beyond which a locking lance 30 extends. The locking lance 30 is struck free along side edges 33 and free end 32 to form a cantilevered structure where the free end 32 extends outward beyond the surface 28. The locking lance 30 is connected to a base 34 within the box-like interior of body portion 8 in cantilevered form. Inwardly folded arms 36 that interconnect with the base 34 are formed by striking openings 38 between the arms 36 and the locking lance 30 and forming second openings 40 on the opposite side of the contact arms 36 as the first openings 38. These arms 36 are seen to extend forwardly and inwardly from ends fixed to body portion 8 to opposed ends joined to base 34, free of sides 33 of the locking lance 30, and are interconnected with the base where the locking lance 30 is cantilevered from. The base can be envisioned as a tie bar like structure, interconnecting the arms 36 and having the locking lance 30 connected thereto between the arms 36 and extending rearward therefrom in a cantilevered manner. The base is formed by striking a portion of material free of the body 8 along line 42. The base and the attached arms 36 are then bent inward into the body portion 8. The base is seen to be spaced from opposed ends of the contact and is deflectable into the interior of body portion 8.

As the contact 2 is inserted into a passageway of a housing, the locking lance 30 interferes with a shoulder therein. The housing is typically constructed so that the shoulder passes closely by surface 28. The free end 32 of the locking lance 30 must be deflected in order to pass. In this embodiment, it is especially advantageous that the cantilever pivot point is located below the surface 28 as a lever arm is created to provide mechanical advantage for deflecting the locking lance 30 inward so that the contact 2 may pass into its seated position. Additionally, by selecting the size and configuration of the supporting arms 36, the arms 36 may be provided with their own resilience enabling the base to be resiliently deflected in response to forces exerted upon the locking lance 30, thereby increasing the effective resilience of the locking lance 30.

Figure 2:
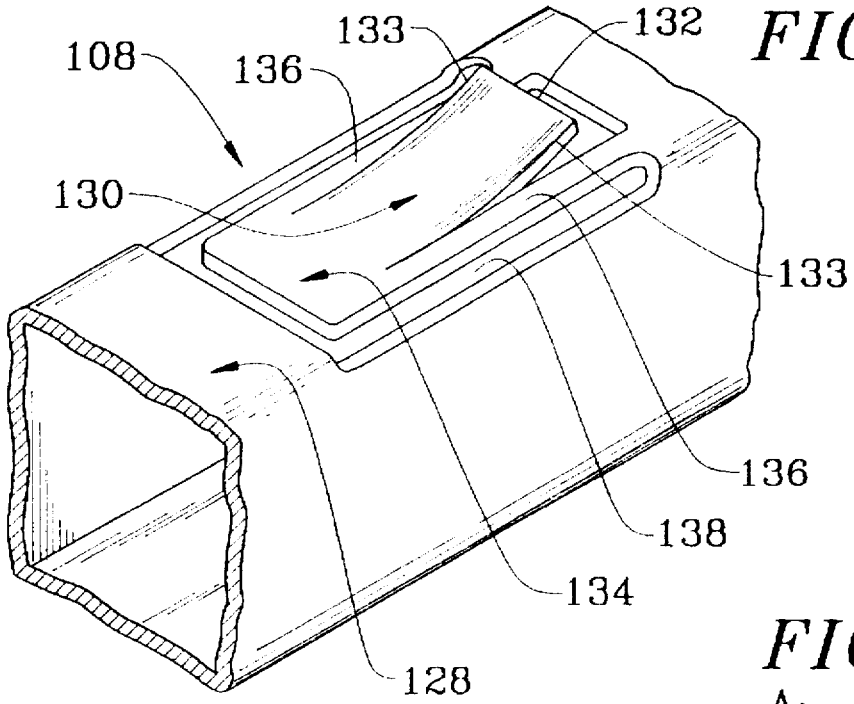
FIG. 2 is a partially broken away view of another embodiment of the present invention.

With reference now to FIG. 2, another embodiment of the invention is shown where a box-like body portion 108 of a contact is shown. This embodiment, along with the others, may be included into a contact as part of an outer back up spring or protective cover. The body portion 108 includes at least one surface 128 having a base portion 134 from which a locking lance 130 is struck outwardly therefrom in a cantilevered manner from cantilever line 131. This produces free sides 133 opposite from one another and a free end 132 opposite the cantilever line 131. The base 134 is defined by a U-shaped cutout defining arms 136 on either side of the locking lance 130 which are interconnected to the surface 128 rearward of where the free end 132 of the locking lance 130. The arms 136 and the base 134 form a second cantilevered structure having its own resilience. By selecting the configuration and length of the arms 136 the desired amount of resiliency for the base 134 may be achieved.

As the contact of this embodiment is inserted into the passageway of the housing, the surface 128 closely passes the shoulder until locking lance 130, which extends therebeyond, interferes with the shoulder. In this embodiment, as opposed to that described above with reference to FIG. 1, initially there is no lever arm for providing mechanical advantage, as the cantilever line 131 is along surface 128 as opposed to being disposed below. In conventional structures, further insertion could only be achieved by the exertion of a significant insertion force. In this embodiment, the base 134 deflects inward by way of arms 136 until the locking lance 130 passes the shoulder or a sufficient lever is created that enables the lance 130 to be resiliently deflected. Especially advantageous in cases where the body portion 8 is an outer back up spring or protective cover, the contact may be configured to allow some initial free deflection of the base 134 before interfering with some other structure to prevent further deflection of the base 134 enabling the resilience of the cantilevered locking lance 130 to be worked, which now is accomplished by use of a lever arm. This could also be achieved in a one piece contact by providing supporting tabs in the body to prevent excessive deflection. In this manner, the dual cantilevered structure may be used to provide the locking lance 130 with compound resiliency for an increase in effective resiliency to achieve the desired resiliency characteristics.

Figure 3:
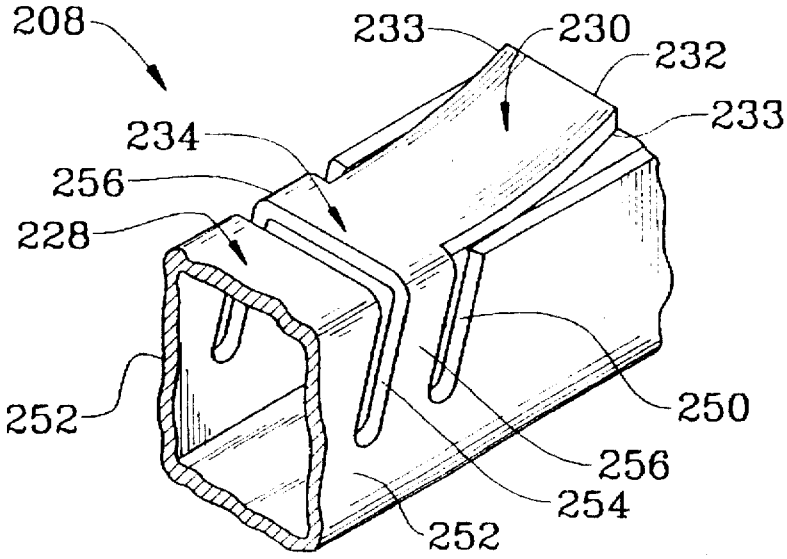
FIG. 3 is a partially broken away perspective view of yet another embodiment of the present invention.

FIG. 3 shows yet another embodiment of the present invention incorporated into a body portion 208 that includes a base 234 from which a locking lance 230 is struck in a cantilevered manner defining sides 233 and free end 232 that extends above surface 228. At the cantilevered location a pair of oppositely disposed slots 250 extending downward from surface 228 across surfaces 252. Forward of the cantilever location is a second slot 254 which extends across surface 228 and partially along surfaces 252. The slots 250 and 254 define strap sections 256 within surfaces 252 that are interconnected with the base 234. In this instance, as the free end 231 of the locking lance 232 interferes with the shoulder of the housing, the base 234 will resiliently deflect due to the slots 250,254. Upon further insertion, either the base portion 234 is prevented from further deflection by interference with another structure or a large enough lever arm is created to deflect the locking lance 230 without an over exertion of insertion forces. The structure, as with that of the previous embodiments, provides compound resiliency, which is the normal resiliency of the cantilevered locking lance plus additional resiliency which in these embodiments is the resilience of the base, enables the contact to be inserted past the shoulder without excessive insertion forces or exceeding the elastic limits of the material.

Figure 4:
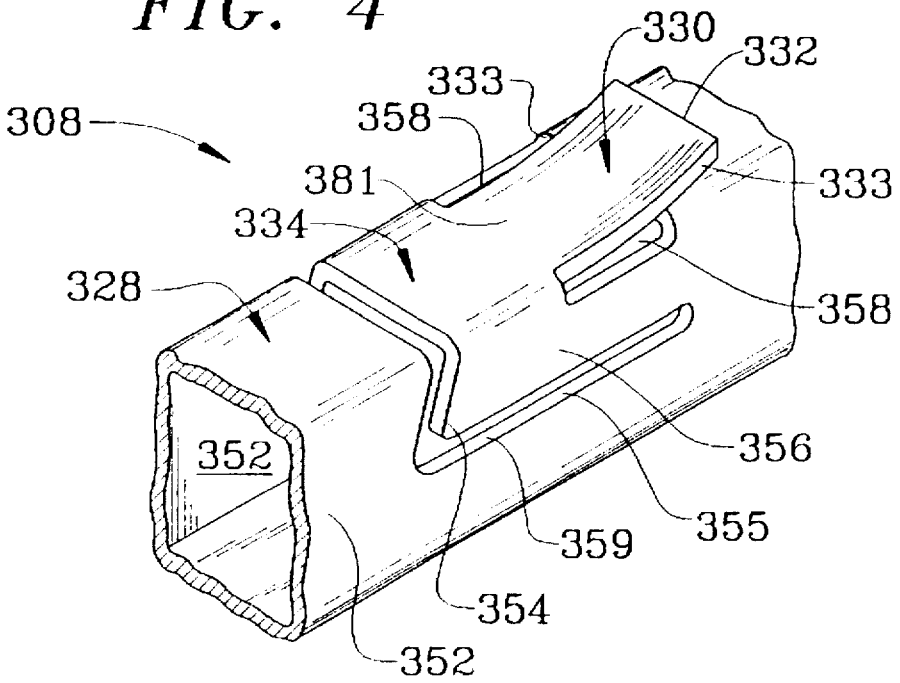
FIG. 4 is a partially broken away perspective view of still another embodiment of the present invention.

With reference now to FIG. 4 still another embodiment of the present invention is shown incorporated into a body portion 308. The body portion 308 includes a surface 328, where a latching lance 330 is struck in a cantilevered manner from a base 334 along cantilever line 331 such that a free end 332 extends beyond the surface 328. Forward of the cantilevered line 331 a slot 354 is formed transverse to the body portion 308 and extends across the surface 328 and down into surfaces 352. The slot 354 includes a longitudinally and rearwardly extending segment 355 that passes rearward along surface 352 of the cantilever line 331 between the base 334 and the locking lance 330. Additional clearance openings 358 are provided on either side of the locking lance 330 and extend from surface 328 into surface 352. The openings 358 and the slot 354, including the segment 355, define L-shaped arms 356 within surfaces 352 that interconnect with the base 334 thereby supporting the base 334 in a cantilevered manner. As a contact incorporating this embodiment is inserted into a housing, the locking lance 330 will interfere with the shoulder. By selecting the configuration of the L-shaped arms 356 the desired resiliency of the base 334 may be achieved. Upon interference, the base 334 is depressed until it is prevented from further deflection by interference with other structure which may advantageously be the body 308 itself along the portion of the wall 352 designated by 359, the locking lance 330 then passes the shoulder or a sufficient lever is developed to enable deflection of the locking lance 330.

Figure 5:
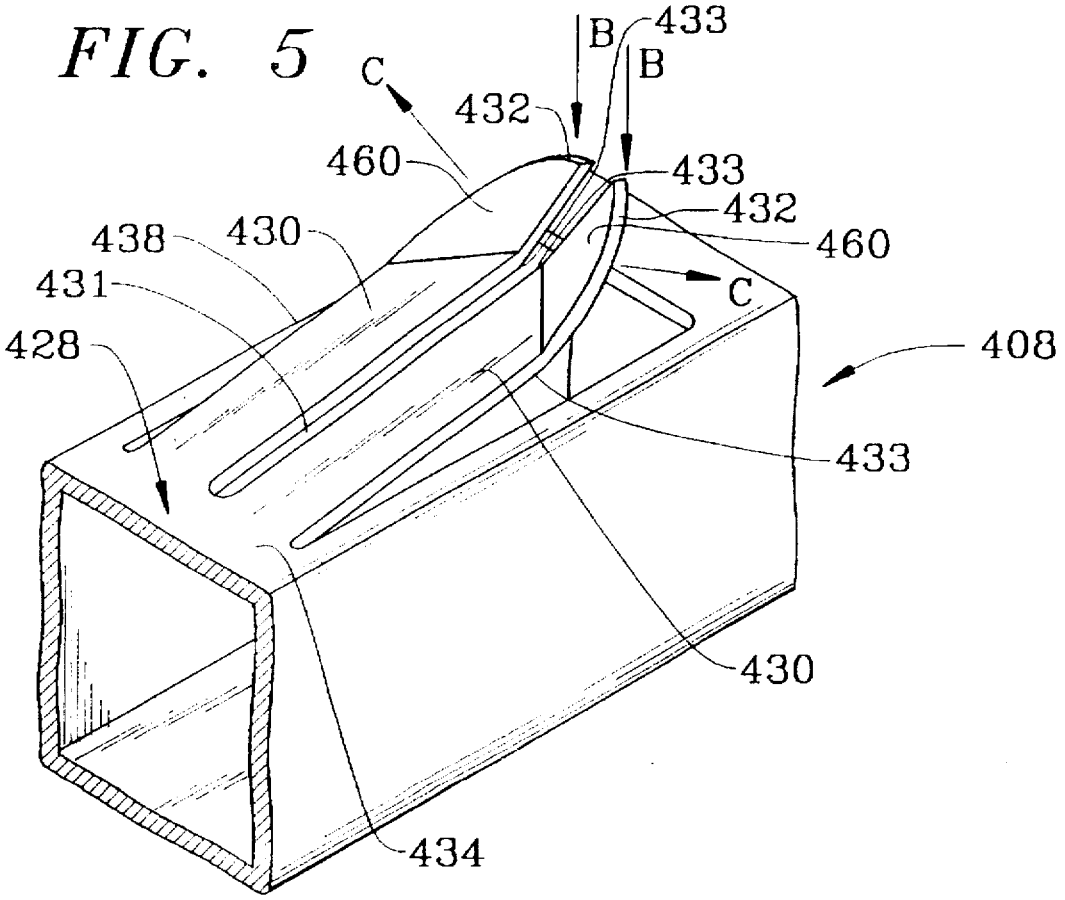
FIG. 5 is a partially broken away perspective view of yet still another embodiment of the present invention.

With reference now to FIG. 5, yet still another embodiment of the invention is shown incorporated into a contact body 408. The contact body 408 has a surface 428 from which a pair of locking lances 430 are struck in cantilevered manner with a longitudinally extending slot 431 therebetween. Each of the lances 430 include sides 433 and free end 432 opposite base 434 from which the locking lance 430 extend in cantilevered from. At the free end 432 of each locking lance 430 is an upwardly folded and angled tab portion 460. In conjunction with the corresponding lance 430, the tab portions 460 form a funnel-like opening that is open towards the cantilever end of the locking lance arms 430 for receiving the shoulder of the housing.

Figure 6:
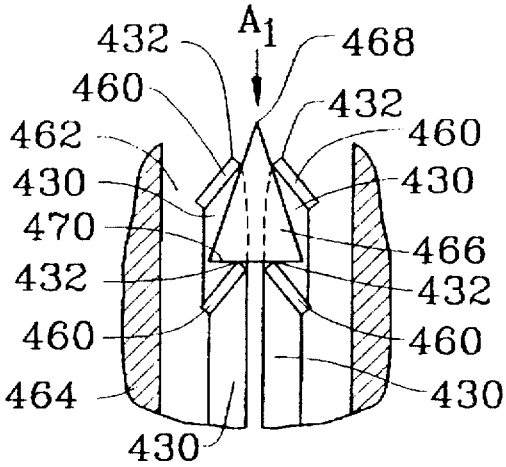
FIG. 6 is an upper view illustrating the working of the embodiment of FIG. 5.

As the contact incorporating this embodiment is inserted into the passageway of the housing the upwardly turned tabs 460 of the locking lance halves 430 interfere with the shoulder of the housing, thereby depressing the free ends 432 of the lance 430 downward in the direction of arrow B and separating the locking lances 430 in the directions of arrow C. This is best seen with reference to FIG. 6 in which insertion into the passageway 462 of the housing 464 occurs in the direction of arrow A1. The housing 464 includes a shoulder 466 of generally triangular shape having a forward portion 468 that is received between the lances 430 and separates them in the directions of arrow C (FIG. 5) while depressing them in the direction of arrow B, thereby providing compound resiliency for the locking lances 430. Once the lances 430 have passed the shoulder 466 the lance 430 resiliently return to their original position by moving in the opposite direction to arrow C and B thereby abutting surface 470 of the shoulder to prevent the contact from being removed from the passageway 462.

Figure 7:
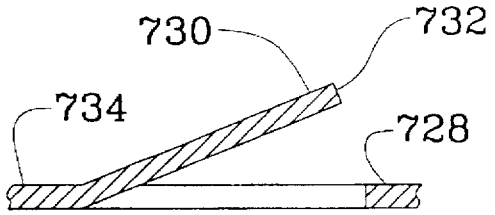
FIG. 7 is a sectional view of a locking lance useable with the present invention.
Figure 8:
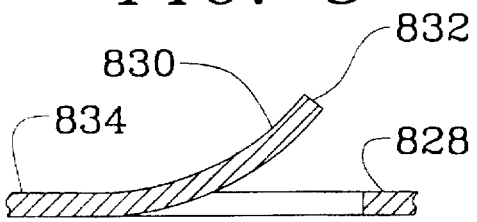
FIG. 8 is a sectional view of another locking lance useable with the present invention.
Figure 9:
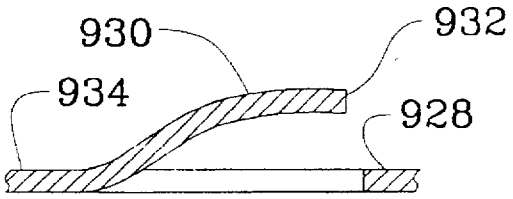
FIG. 9 is a sectional view of still another locking lance useable with the present invention.
Figure 10:
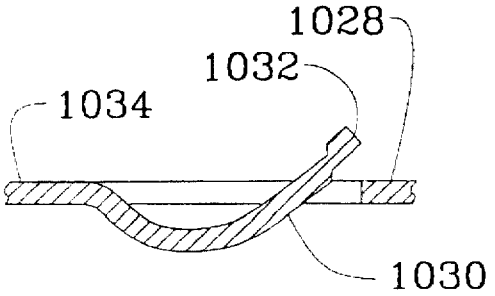
FIG. 10 is a sectional view of still another locking lance useable with the present invention.

FIGS. 7–10 illustrate a number of possible embodiments of the locking lances that may be especially advantageous and could be used with the embodiments of FIGS. 1–4. FIG. 7 illustrates a conventional locking lance 730 struck from surface 728 and cantilevered at base 734 to free end 732 in a linearly extending manner. FIG. 8 illustrates a locking lance 830 struck from surface 828 and cantilevered from base 834 in a concave upwardly opened manner to free end 832. FIG. 9 illustrates a locking lance 930 struck outward from surface 928 and cantilevered at base 934 where the locking lances extends initially outward before entering concave section opened downwardly that extends to free end 932 positioned above the surface 928. FIG. 10 illustrates yet another locking lance 1030 struck from surface 1028 and cantilevered at base 1034 that initially is struck inwards before entering an upwardly open concave section that extends to free end 1032 which is disposed above 1028. These locking lance configurations are not meant to be limiting although they may provide additional features that are desirable, such as improved insertion, improved retention, or possibly additional resiliency.

Advantageously, the present invention enables less structure to be devoted to the locking lance portion of an electrical contact, thereby enabling miniaturization and the addition of additional features that may be desirable in an electrical contact. It is further advantageous that this invention is simple and economical to manufacture and may be incorporated into the normal manufacturing processes of an electrical contact. Finally, it is advantageous that this invention may be incorporated into electrical connectors of different styles and configurations, such as one piece or multiple piece structures, receptacle or pin style contacts of whatever cross-sectional shape is desired.

We claim:

1. An electrical contact receivable in a passageway of a connector housing to be retainable therein, the contact comprising a contact portion and a conductor engaging portion joined together by a channel-like body portion having an interior defined by an outer shell wall where the body portion includes a pair of spaced apart and opposing resilient arms formed from the outer shell wall, each of the arms extending from an end fixed to the body portion to an opposed end where the opposed ends are joined together spaced from opposed ends of the contact to define a U-shaped support member defining a base deflectable into the interior during contact insertion, a locking lance extends from the base in cantilevered fashion between the two resilient arms to a free end disposed outward from the body portion, whereby upon insertion of the contact into the passageway the locking lance interferes with the housing thereby deflecting the opposed ends of the resilient arms into the interior thus allowing contact insertion into the housing, and upon full contact insertion the resilient arms resile forwardly of a housing shoulder along the passageway thereby bringing the free end of the locking lance into position to interfere with the shoulder such that withdrawal of the contact is prevented.

2. The contact of claim 1, wherein the resilient arms are longer than the cantilevered locking lance.

3. The contact of claim 1, wherein the resilient arms are arranged parallel one another.

4. The contact of claim 1, wherein the outer shell wall includes at least a base portion and side portions extending along the base portion, the resilient arms and the base being formed from the base portion.

5. The contact of claim 4, wherein the U-shaped support member is co-existant with the base portion prior to exertion of an interference force on the locking lance.

6. The contact of claim 4, wherein the resilient arms are formed with a bend such that they extend into the interior of the body portion prior to exertion of an interference force on the locking lance.

7. The contact of claim 1, wherein the outer shell wall includes a base portion and side portions extending along the base portion, the resilient arms each being formed from a corresponding one of the side portions and the base being formed from the base portion.

8. The contact of claim 7, wherein the U-shaped support member is co-existent with the base portion and respective side portions prior to exertion of an interference force on the locking lance.

9. The contact of claim 7, wherein the base portion and the side portions are generally planar members or oriented transversely to one another.

10. An electrical contact receivable in a passageway of the connector housing and being retainable therein, the contact comprising a contact portion and a conductor engaging portion joined together by a channel-like body portion having an interior defined by an outer shell wall, the outer shell wall having a U-shaped cutout therein spaced from opposed ends of the contact defining a cantilever tongue deflectable into the interior during contact insertion into the housing, where a locking lance is struck from the middle of the tongue and is reversely cantilevered with respect thereto in a manner that extends away from the body portion to a free end such that a U-shaped support member having resilient arms on either side of the locking lance and joined together by a base from which the locking lance extends is defined that is deflectable into the interior during contact insertion.

* * * * *